US007607802B2

(12) United States Patent
Kang et al.

(10) Patent No.: US 7,607,802 B2
(45) Date of Patent: Oct. 27, 2009

(54) LED LAMP INSTANTLY DISSIPATING HEAT AS EFFECTED BY MULTIPLE-LAYER SUBSTRATES

(75) Inventors: Shung-Wen Kang, Taipei (TW); Kun-Cheng Chien, Tamsui (TW)

(73) Assignee: Tamkang University, Tamsui (TW)

( * ) Notice: Subject to any disclaimer, the term of this patent is extended or adjusted under 35 U.S.C. 154(b) by 167 days.

(21) Appl. No.: 11/880,372

(22) Filed: Jul. 23, 2007

(65) Prior Publication Data

US 2009/0027889 A1 Jan. 29, 2009

(51) Int. Cl.
*F21V 29/00* (2006.01)

(52) U.S. Cl. ..... 362/294; 362/373; 362/800

(58) Field of Classification Search ..... 362/294, 362/373, 218, 580
See application file for complete search history.

(56) References Cited

U.S. PATENT DOCUMENTS 5,980,066 A * 11/1999 Belliveau et al. ..... 362/281
6,019,493 A * 2/2000 Kuo et al. ..... 362/335
7,144,140 B2 * 12/2006 Sun et al. ..... 362/373
7,198,386 B2 * 4/2007 Zampini et al. ..... 362/294
7,322,718 B2 * 1/2008 Setomoto et al. ..... 362/276
7,482,632 B2 * 1/2009 Lu et al. ..... 257/88
2005/0207166 A1 * 9/2005 Kan et al. ..... 362/373
2007/0159827 A1 * 7/2007 Huang ..... 362/294
2007/0285926 A1 * 12/2007 Maxik ..... 362/294
2009/0002995 A1 * 1/2009 Lee et al. ..... 362/294

* cited by examiner

*Primary Examiner*—Sandra O'Shea
*Assistant Examiner*—Evan Dzierzynski

(57) ABSTRACT

A LED lamp includes: a plurality of substrates juxtapositionally formed as multiple layers, each substrate having a plurality of light emitting diodes (LEDs) mounted thereon, whereby upon generation of heat by the LEDs when lit up, each substrate will form as a heat-dissipating plate in-situ in order that the multiple-layer substrates will instantly effectively dissipate the heat produced from the LEDs of the lamp outwardly for preventing deterioration of the illumination quality of the LED lamp.

4 Claims, 7 Drawing Sheets

Fig. 8
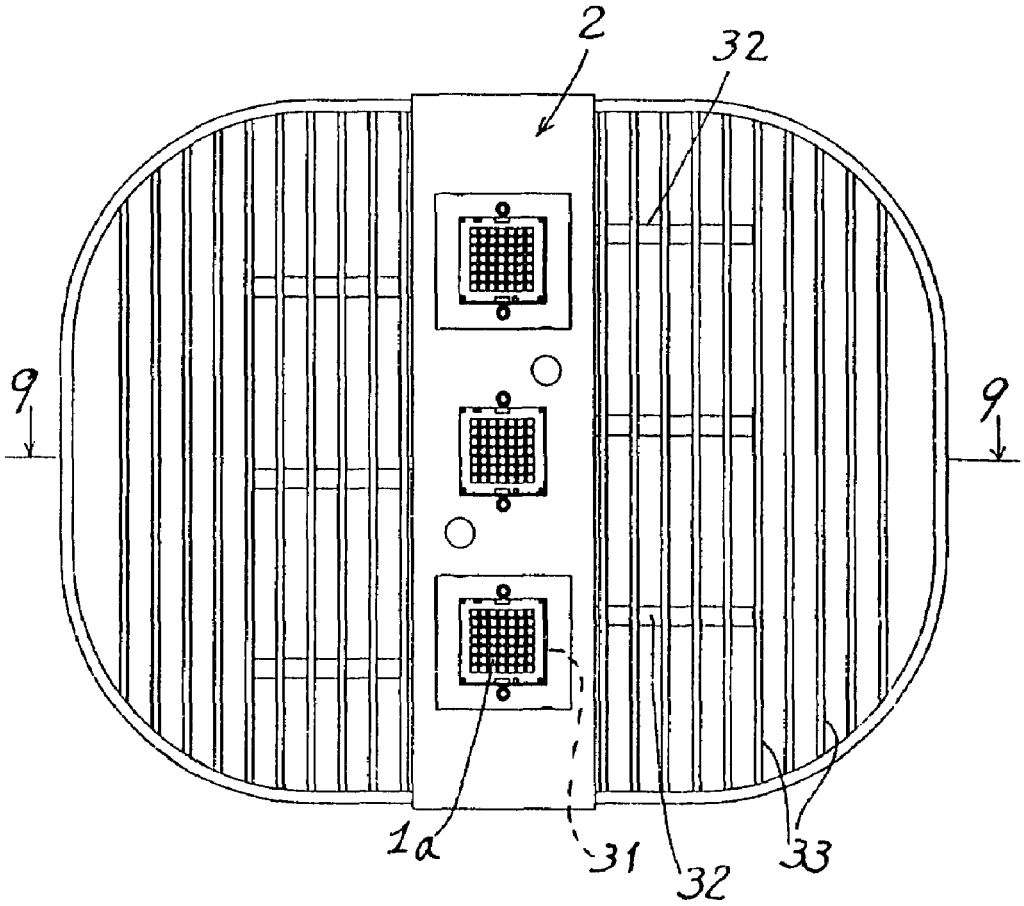
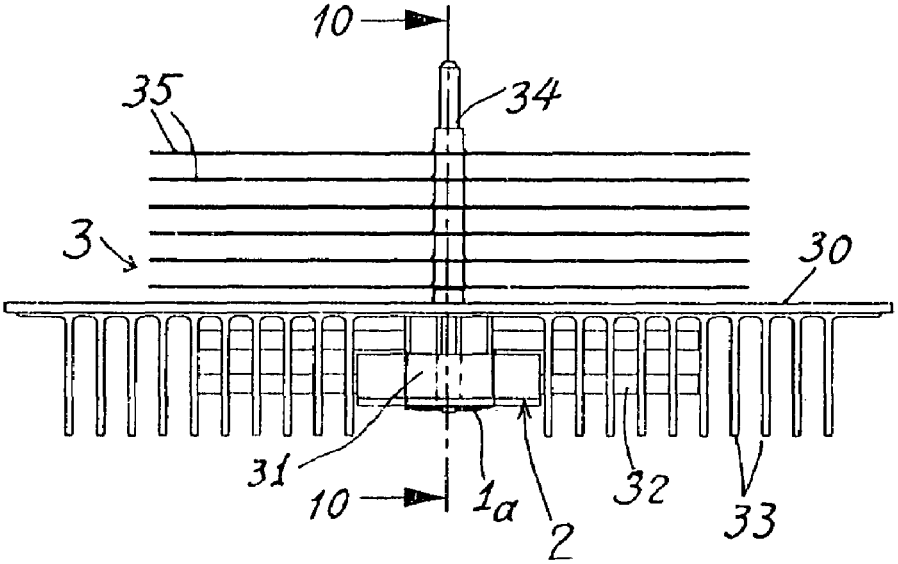
Fig. 9

LED LAMP INSTANTLY DISSIPATING HEAT AS EFFECTED BY MULTIPLE-LAYER SUBSTRATES

BACKGROUND OF THE INVENTION

Once a LED lamp having a plurality of light emitting diodes is lit up, the LEDs or LED module will rapidly increase their temperature to accumulate heat in the lamp. If the heat is not well dissipated, it may cause flicker and deteriorate the illumination quality of the LED lamp, thereby shortening the service life of the lamp.

U.S. Pat. No. 6,793,374 disclosed a LED lamp having a gear column connected between a cap and substrates. The substrates are arranged as a polyhedron with planar surfaces. A fan is provided in the column for cooling the substrates and LEDs.

However, such a prior art has the following drawbacks:

1. The LED substrates are formed as a polyhedron, which is a closed "housing" to greatly accumulate the heat produced by LEDs in the column, being difficult to dissipate the heat satisfactorily.
2. A fan (9) should be installed in the column for cooling the lamp, increasing the cost of installation, operation and maintenance. It also requires electric energy for driving the fan, wasting energy on a viewpoint of environmental protection.
3. The rotation of the fan may cause vibration of the lamp, possibly damaging the circuit of LEDs or even making short circuit of the LED circuit of the lamp, thereby being inoperative accordingly.

The present inventor has found the drawbacks of the prior art and invented the LED lamp for instantly and effectively dissipating the heat from the lamp.

SUMMARY OF THE INVENTION

The object of the present invention is to provide a LED lamp including: a plurality of substrates juxtapositioned as multiple layers, each substrate having a plurality of light emitting diodes (LEDs) mounted thereon, whereby upon generation of heat by the LEDs, each substrate will form as a heat-dissipating plate in-situ in order that the multiple-layer substrates will instantly effectively dissipate the heat from the LEDs of the lamp outwardly for preventing deterioration of the illumination quality of the LED lamp.

BRIEF DESCRIPTION OF THE DRAWINGS

FIG. 8 is a bottom view of the LED lamp as shown in FIG. 7 by removing the transparent cover.

FIG. 9 is a sectional drawing as viewed from Line 9-9 direction of FIG. 8.

DETAILED DESCRIPTION

Figure 1:
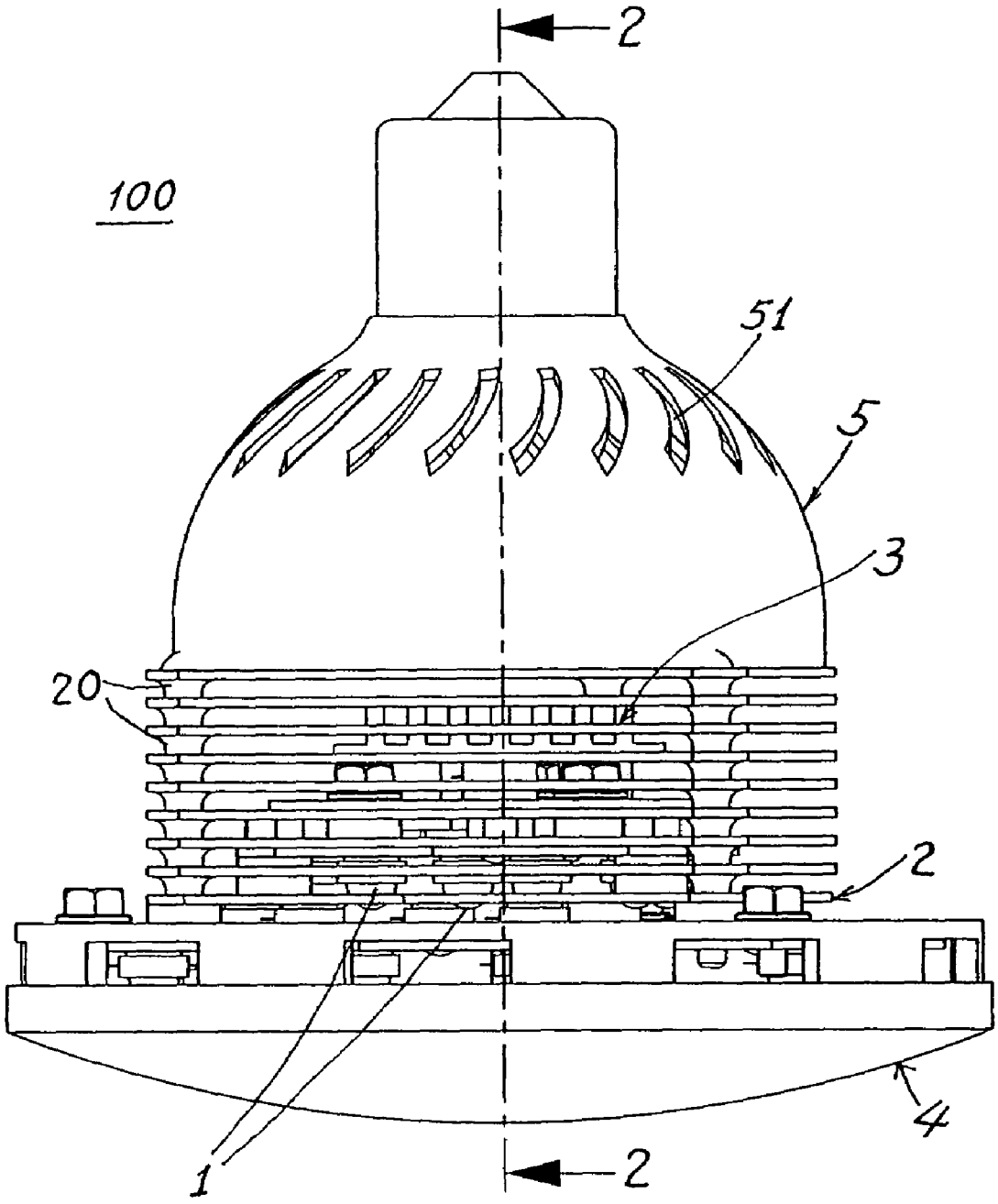
FIG. 1 is an illustration showing an assembled LED lamp in accordance with the present invention.
Figure 2:
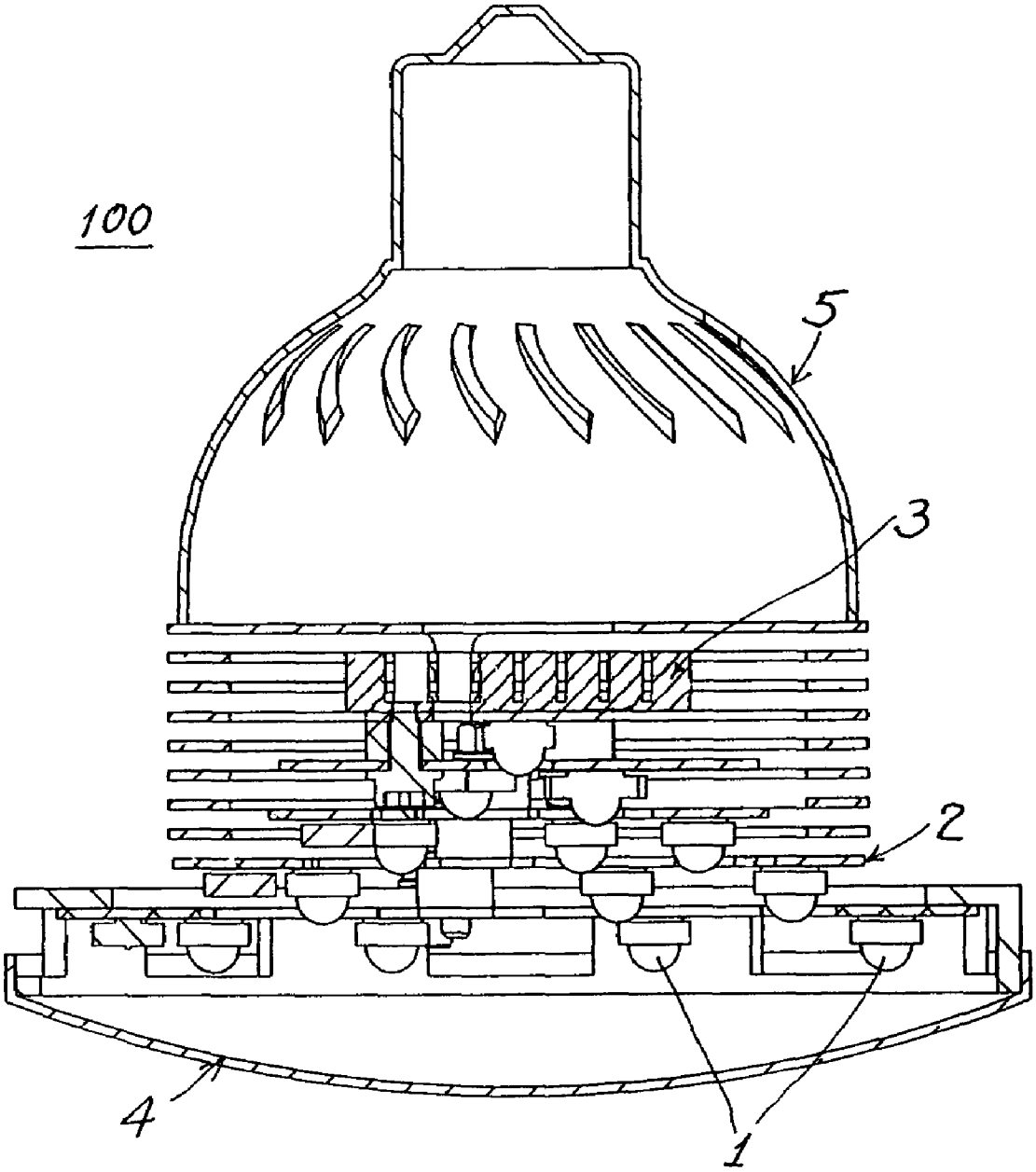
FIG. 2 is a sectional drawing of the present invention as viewed from Line 2-2 direction of FIG. 1.

As shown in FIGS. 1~5, a LED lamp (or lighting fixture) 100 of the present invention comprises: a plurality of light-emitting diodes or LEDs 1; a plurality of substrates 2, 2*a*~2*d* juxtapositionally formed as a multiple-layer structure; each substrate 2, 2*a*~2*d* having at least a light emitting diode or LED 1 mounted thereon; and at least a heat-dissipating device 3 secured to one substrate of the plurality of substrates 2, 2*a*~2*d*; a transparent cover (or lens cover) 4 mounted on a front portion or a light-output side of the LED lamp 100; and at least a lamp shade 5 mounted on a rear portion or inner portion of the LED lamp 100.

The light emitting diodes 1 may be secured or mounted on each substrate 2, 2*a*~2*d* by individual LEDs, an annular array, a LED module, or any other array arrangements or lay-out, not limited in the present invention.

The number, shapes, mounting or assembly methods of the elements of the present invention are not limited.

The LEDs may be electrically connected to a LED circuit which is formed on a circuit board secured or integrally formed with the substrate 2, 2*a*~2*d* of the present invention. The electrical insulation for the LED circuit with the other elements should also be considered.

The plurality of substrates 2, 2*a*~2*d* may be juxtapositioned with one another to be a multiple-layer structure, with every two neighboring substrates defining an air space A therebetween for increasing the contacting area between the substrates and the air, in order for increasing the heat dissipation area for instantly effectively dissipating heat outwardly.

The substrate is made of heat conductive material having good heat dissipation property and may be selected from: copper, aluminum, aluminum alloy and other composites having good heat conducting and dissipating properties.

Figure 3:
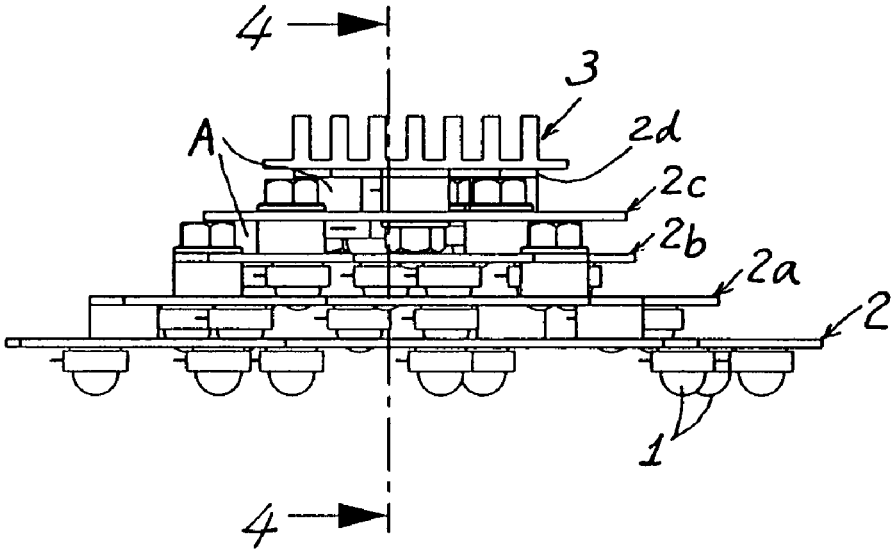
FIG. 3 is a side-view illustration of the present invention when removing the transparent cover and lamp shade.
Figure 4:
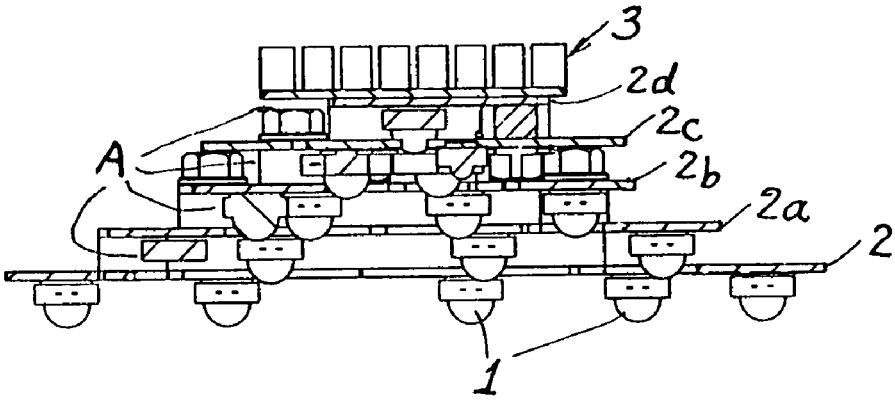
FIG. 4 is a sectional drawing as viewed from Line 4-4 direction of FIG. 3.
Figure 5:
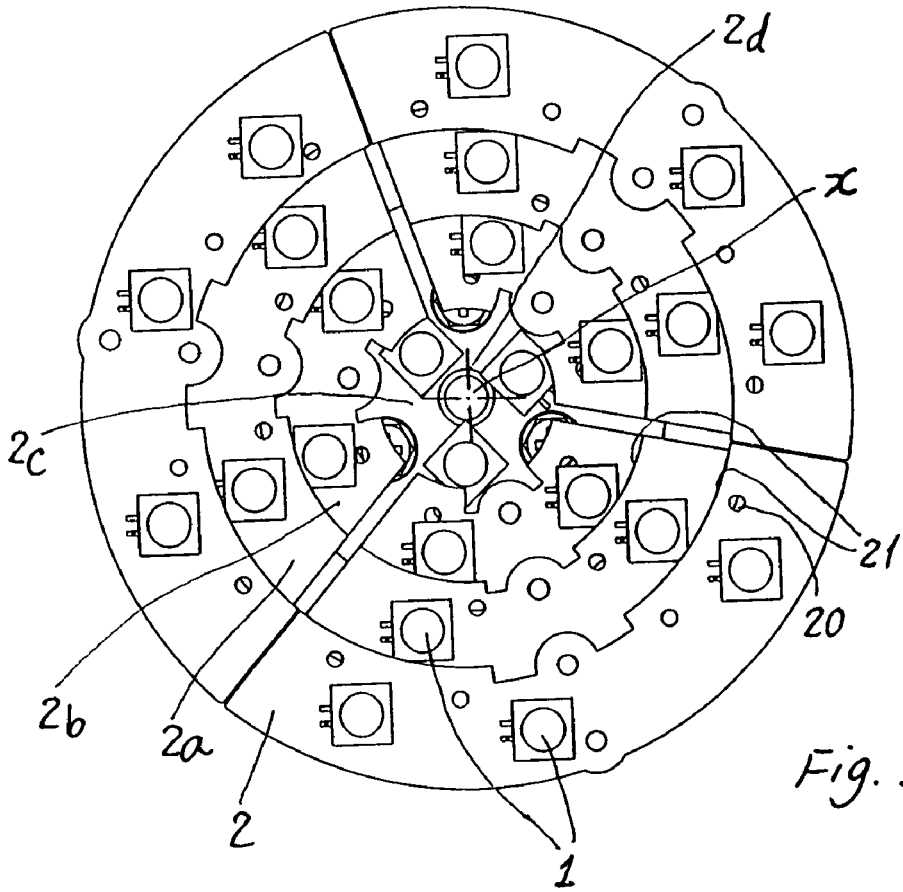
FIG. 5 is a bottom view of FIG. 3.
Figure 6:
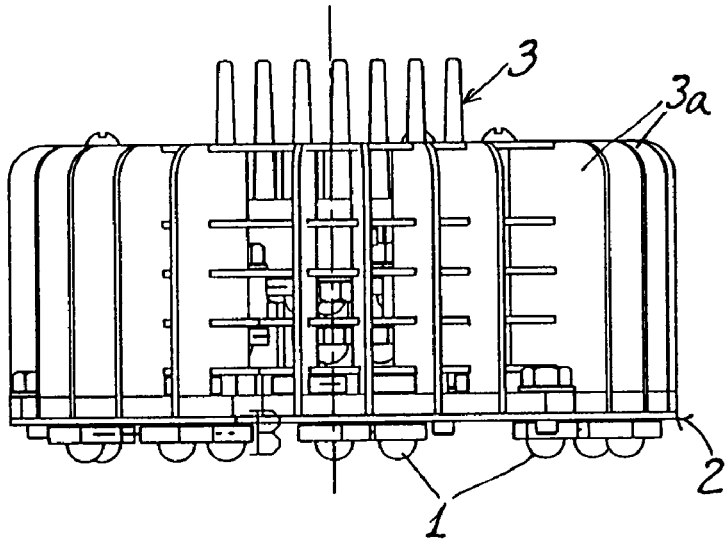
FIG. 6 is a modification of the present invention by adding vertical heat-dissipating fins to the example of FIG. 1.

The plurality of substrates 2, 2*a*~2*d* are gradationally juxtapositionally mounted on the LED lamp about a longitudinal axis X of the LED lamp as shown in FIGS. 3~5 to be multiple layers of substrates, each substrate formed as an annular shape and defining a central opening 21 for each substrate, which is gradually decreasing an inside diameter of the central opening 21 of the annular-shaped substrate from an outer (or front) substrate to an inner (or rear) substrate (especially as shown in FIG. 5), each substrate having a plurality of light emitting diodes 1 concentrically mounted thereon, and each light emitting diode 1 on an inner substrate projecting its light outwardly through a central opening 21 of an outer substrate neighboring to the inner substrate without obstruction of an output light projection of the light emitting diodes 1.

Every two neighboring substrates are connected by a fastening element 20 such as a bolt; and having a heat dissipating device 3 secured to an innermost substrate 2*d* of the substrates for further dissipating heat outwardly.

The heat dissipating device 3 may includes a plurality of heat dissipating fins.

The number of substrates 2 and the areas of the substrates may be variable and adjustable, depending upon the watts of the LEDs. For example, a LED lamp with high power or high watts, the number of LEDs and substrates may then be increased correspondingly.

The light emitting diode 1 may be mounted on the substrate 2 by the aid of a heat sink slug for enhancing the heat transfer from the LED to the substrate, through which the heat as produced by the LED will be effectively dissipated outwardly.

The LED circuit may be directly printed or formed on an outer surface of the substrate 2, and an inner surface of the substrate may be formed as a rough surface to increase its contacting area with the air to increase its heat dissipation efficiency.

A plurality of vertical heat-dissipating fins 3*a* may be radially secured to the plurality of substrates 2, 2*a*~2*d* to further increase the heat dissipating area and heat dissipating efficiency.

Such a vertical heat-dissipating fins 3*a* may also protect the direct contact with the LEDs, thereby preventing unexpected injury caused by the heat of the LEDs.

The lamp shade 5 may be formed with a plurality of ventilation holes 51 for facilitating the air ventilation in the LED lamp for helping heat dissipation from the LEDs.

The LED may be oriented in any light-output direction or in a straightforward direction for projecting light outwardly in the directions according to the practical requirements, not limited in the present invention.

The present invention is superior to the prior art or conventional LED lamps with the following advantages:

1. Each substrate 2 having the LEDs 1 mounted thereon will form in-situ as a heat dissipating plate for an instant and efficient dissipation of heat as produced by the LEDs.
2. The substrates are mounted in multiple layers, with every two neighboring substrates defining an air space therebetween to greatly increase the contact area with the surrounding air, thereby increasing the heat dissipating area and efficiency.
3. The substrates are juxtapositionally mounted as a multiple-layer structure, so that the light-emitting diodes may be "distributed" into the plural substrates, providing a space-saving factor helpful for the lay-out of LED lighting fixture in a building, a house or an upholstery.
4. The well heat dissipation of the multiple-layer substrates may thus eliminate the installation of a cooling fan in the LED lamp for saving energy and cost.

Another preferred embodiment of the present invention is shown in FIGS. 7~10, which will be described in detail hereinafter.

The LED lamp 100 includes: a plurality of LED modules 1*a* (such as LED array or multi-chip LED array) respectively thermally connected to a plurality of substrates 2 which may be juxtapositionally formed as multiple layers, each substrate 2 thermally connected with at least a heat dissipating device 3, a transparent cover 4 mounted on a front or outer portion of the LED lamp 100, and at least a lamp shade 5 secured to a rear or inner portion of the LED lamp 100 and connected with an inner portion of the heat dissipating device 3; with said plurality of substrates encased in between the transparent cover 4 and lamp shade 5.

Each LED array may be mounted on the substrate 2 with any desired light-output angles or directions, not limited in this invention.

The plurality of substrates 2 may be juxtapositionally superimposed to define an air space A between every two neighboring substrates 2 (FIG. 7), each substrate 2 having at least a LED module 1*a* mounted thereon.

Figure 7:
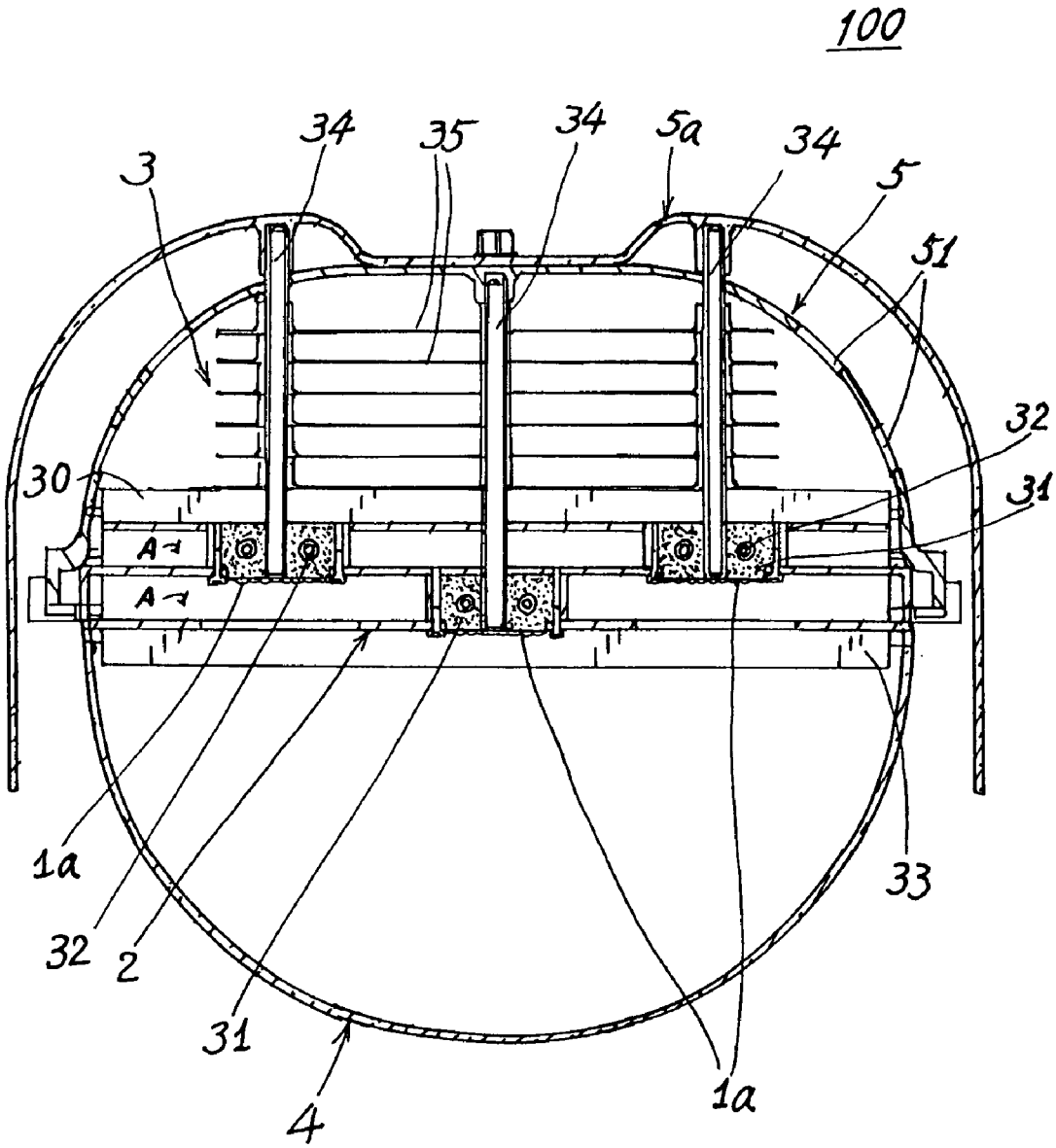
FIG. 7 shows another preferred embodiment of the present invention.

The plurality of substrates 2 may be formed as a multiple-layer cassette as show in FIG. 7.

The heat dissipating device 3 includes: a plurality of heat-transfer blocks 31 each block 31 connected with at least one substrate 2 and each block 31 having an outer surface portion connected with one said LED module 1*a*; a plurality of horizontal heat pipes 32 having at least one horizontal heat pipe 32 horizontally connected with each heat-transfer block 31; a plurality of vertical heat-dissipating fins 33 perpendicularly connected with the horizontal heat pipes 32; a plurality of vertical heat pipes 34 each vertically connected to each heat-transfer block 31; and a plurality of horizontal heat-dissipating plates 35 perpendicularly connected with the vertical heat pipes 34.

The vertical heat-dissipating fins 33 are separated from the horizontal heat-dissipating plates 35 by a diaphragm 30.

Each heat pipe 32 or 34 is filled with vaporizable working fluid or heating medium therein for conducting and dissipating heat as produced from the LED modules 1*a*.

The lamp shade 5 is made of heat conductive materials and includes a plurality of ventilation holes 51 formed through the lamp shade 5 for venting hot air outwardly, with the inner end portions of the vertical heat pipes 34 connected with the lamp shade 5, which will play as a big heat-dissipating plate for dissipating heat outwardly.

The lamp shade 5 is further connected with a water-proof shade 5*a* juxtapositioned to the lamp shade 5 to prevent rain water or water droplets to enter the interior of the lamp 100; and the water-proof shade 5*a* is connected with partial vertical heat pipes 34 for further conducting and dissipating heat outwardly as thermally transferred from the heat pipes 34 as shown in FIG. 7.

Therefore, the water-proof shade 5*a* may also play as another heat-dissipating plate next to the lamp shade 5 as above-mentioned.

This preferred embodiment (as shown in FIGS. 7~10) has the following advantages superior to the prior art:

1. The heat dissipation may be effected in multiple ways such as by the vertical fins 33 and by the horizontal plates 35 for efficiently dissipating heat.
2. The LED modules 1*a* are distributed on plural or multiple-layer substrates 2 to instantly dissipate heat directly from each substrate, preventing unexpected heat accumulation or "focusing" of heat on a single substrate or location.
3. Multiple layers of substrate 2 may minimize the space or volume for well accommodating LEDs on the substrates, thereby saving space and being beneficial to architectural or upholstery design.
4. The lamp shade 5 and the water-proof shade 5*a* may be inferentially considered as big "double" heat-dissipating fins for further dissipating the heat on a rear or inner portion of the LED lamp 100.

Figure 10:
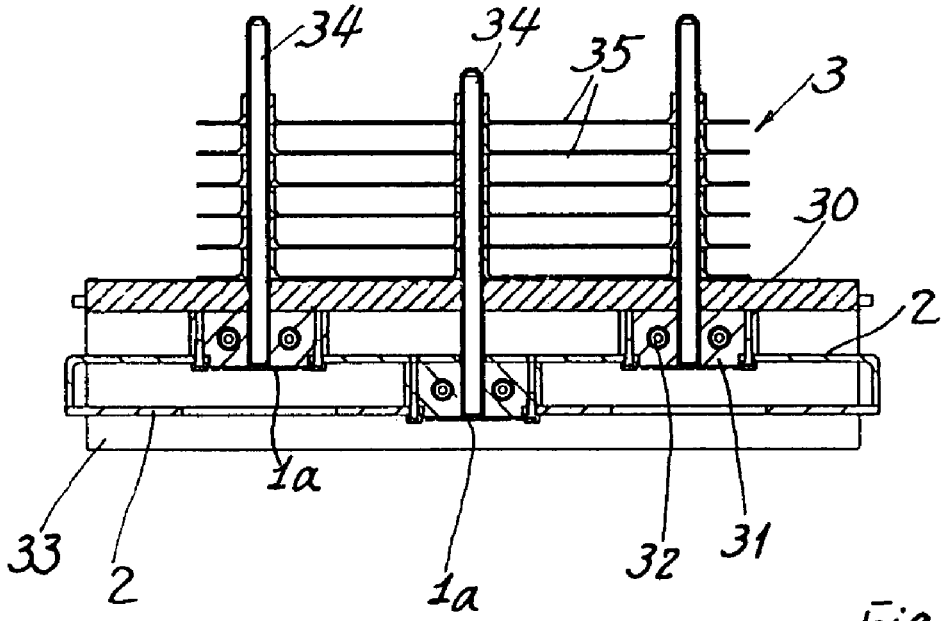
FIG. 10 is a sectional drawing when viewed from Line 10-10 of FIG. 9.
Figure 11:
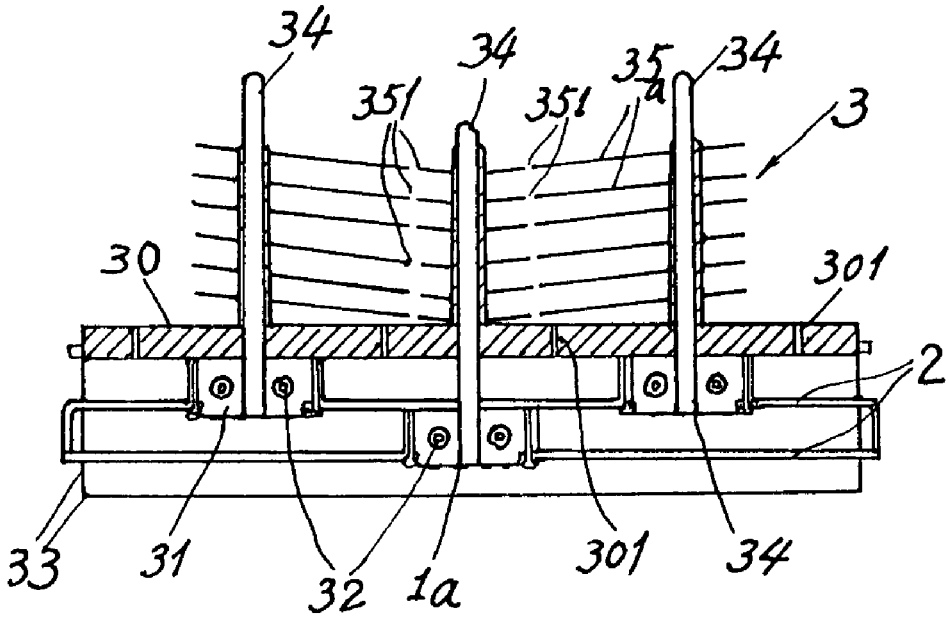
FIG. 11 is a modification of the present invention as modified from FIG. 10.

As shown in FIG. 11, the horizontal heat-dissipating plates 35 in FIG. 10 have been modified to be heat-dissipating plates 35*a* each slightly inclined sidewardly outwardly towards a plurality of ventilation holes formed in the lamp shade (referable to FIG. 7) to thereby smoothly guide the hot air upwardly outwardly through the. inclined plates 35*a*. Meanwhile, a plurality of ventilation openings 351, 301 are formed through the heat-dissipating plates 35*a* and diaphragm 30 for helping the heat convection of the hot air through the openings for enhancing the heat dissipation.

The present invention may be used as a LED bulb, a LED street lamp or any other LED lamps, not limited.

The present invention may be modified without departing from the spirit and scope of the present invention.

We claim:

1. A LED lamp comprising:

a plurality of LED modules including LED array and multi-chip LED array respectively thermally connected to a plurality of substrates which are juxtapositionally formed as multiple layers, each said substrate thermally connected with at least a heat dissipating device, a transparent cover mounted on a front portion of the LED lamp, and at least a lamp shade secured to a rear portion of the LED lamp and connected with an inner portion of the heat dissipating device; with said plurality of said substrates encased in between the transparent cover and the lamp shade; and said heat dissipating device including: a plurality of heat-transfer blocks each said block connected with at least one said substrate and each said block having an outer surface portion connected with one said LED module; a plurality of horizontal heat pipes having at least one said horizontal heat pipe horizontally connected with each said heat-transfer block; a plurality of vertical heat-dissipating fins perpendicularly connected with the horizontal heat pipes; a plurality of vertical heat pipes each vertically connected to each said heat-transfer block; and a plurality of horizontal heat-dissipating plates perpendicularly connected with the vertical heat pipes.

2. A LED lamp according to claim 1, wherein said lamp shade is made of heat conductive materials and includes a plurality of ventilation holes formed through the lamp shade for venting hot air outwardly; with the inner end portions of the vertical heat pipes connected with the lamp shade for dissipating heat outwardly.

3. A LED lamp according to claim 1, wherein said lamp shade is further connected with a water-proof shade juxtapositioned to the lamp shade to prevent water to enter the interior of the LED lamp; and the water-proof shade connected with partial said vertical heat pipes for further conducting and dissipating heat outwardly as thermally transferred from the vertical heat pipes.

4. A LED lamp according to claim 1 wherein said horizontal heat-dissipating plates are each slightly inclined sidewardly outwardly towards a plurality of ventilation holes formed in the lamp shade to smoothly guide the hot air upwardly outwardly; and a plurality of ventilation openings formed through the heat-dissipating plates for helping heat convection of hot air through the openings for enhancing the heat dissipation.

* * * * *